US008266771B2

(12) United States Patent
Scott, Jr.

(10) Patent No.: US 8,266,771 B2
(45) Date of Patent: Sep. 18, 2012

(54) TWIST TYPE FENCE TIE

(76) Inventor: Coley A. Scott, Jr., Prairieville, LA (US)

( * ) Notice: Subject to any disclaimer, the term of this patent is extended or adjusted under 35 U.S.C. 154(b) by 479 days.

(21) Appl. No.: 12/568,895

(22) Filed: Sep. 29, 2009

(65) Prior Publication Data

US 2010/0088858 A1 Apr. 15, 2010

Related U.S. Application Data

(60) Provisional application No. 61/195,694, filed on Oct. 9, 2008.

(51) Int. Cl.
*E04H 17/02* (2006.01)

(52) U.S. Cl. ..... 24/27; 256/57; 403/392

(58) Field of Classification Search ..... 24/27, 30.5 T; 256/46–48, 32–35, 56, 57; 403/392
See application file for complete search history.

(56) References Cited

U.S. PATENT DOCUMENTS

| | | | | |
|---|---|---|---|---|
| 385,318 | A | 6/1888 | Norris | |
| 1,076,245 | A * | 10/1913 | Slosson | 24/27 |
| 1,153,380 | A | 9/1915 | Fussell | |
| 1,190,080 | A | 7/1916 | Bailey | |
| 1,460,936 | A | 7/1923 | Bailey | |
| 1,469,623 | A * | 10/1923 | Colombani | 24/552 |
| 1,667,463 | A * | 4/1928 | Rose | 256/57 |
| 2,795,399 | A | 6/1957 | Anderson | |
| 5,275,383 | A * | 1/1994 | Wick et al. | 256/57 |
| 5,735,508 | A * | 4/1998 | Lancour et al. | 256/57 |
| 5,788,201 | A * | 8/1998 | Hardison | 248/302 |
| 6,401,306 | B1 * | 6/2002 | Hanten et al. | 24/30.5 W |
| 2004/0016917 | A1 | 1/2004 | Hoepfner | |

FOREIGN PATENT DOCUMENTS

DE 202005005959 U1 * 7/2005

* cited by examiner

*Primary Examiner* — James Brittain
(74) *Attorney, Agent, or Firm* — Kean Miller LLP

(57) ABSTRACT

An improved fence tie and methods of using that fence tie are disclosed. Dimensions for bending wire are described for bending a wire to form a helical section, two straight ends and a straight section adjacent to the helical section in a configuration having a form that generally resembles certain known twist type fence ties.

7 Claims, 1 Drawing Sheet

TWIST TYPE FENCE TIE

CROSS REFERENCE TO RELATED APPLICATIONS

This application claims the benefit of U.S. Provisional Patent Application 61/195,694 entitled Improved Twist Type Fence Tie.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

BACKGROUND

The fencing industry is driven in large part by the costs of materials and labor associated with the construction of fences. Because of this, inexpensive fencing materials that can reduce the amount of labor required are highly desirable. Affixing the fence fabric to a fence post is an important and repetitive step in most fence installations. For this reason, an inexpensive fence tie that facilitates high quality fastening with reduced time and effort can improve upon the time and cost associated with building fences.

Information relevant to attempts to address these needs can be found in U.S. Pat. Nos. 5,735,508 entitled TIE AND METHOD FOR SECURING FENCE FABRIC TO SUPPORTS; 385,318 entitled IMPLEMENT FOR BENDING WIRE; 1,460,936 entitled FENCEPOST ATTACHMENT; 2,795,399 entitled SNOW FENCE; 1,190,080 entitled FENCE-POST 1,153,380 entitled FENCE POST; 1,667,463 entitled FASTENING DEVICE FOR FENCING, ETC.; 5,275,383 entitled METHOD AND WIRE TIE CONNECTION FOR SECURING FENCING FABRIC TO POSTS; 1,667,463 entitled FASTENING DEVICE FOR FENCING, ETC. and United States Patent Application Publication 2004/0016917 entitled DEVICE AND METHOD FOR TWIST FASTENING WIRE. However, each of the above references suffer from at least one of the following deficiencies: longer installation time, lack of an adequate indicator of wire tension, difficulties in opening and closing the fence tie, higher cost of installation, and poor reliability and durability in service. For the foregoing reasons there is a need for an inexpensive fence tie that facilitates high quality fastening with reduced time and effort, and methods for applying such fence ties.

SUMMARY

Disclosed herein are embodiments of the present invention that address the needs described above by providing devices and methods that can be used for the installation of fencing, and more particularly for the affixing of fencing fabric to a fence post.

A device having features of the present invention includes a fence post tie comprising an elongate deformable member that includes a substantially straight first end; a substantially straight second end that is opposite the first end with respect to the length of the member; and a central segment that is capable of substantially conforming to the outer surface of a cylindrical post without deforming the member; wherein the central segment contains both an arcuate region and a substantially linear region. In several related but independent embodiments: the arcuate region is in the form of a helix; the helix has a pitch of between 0.2 and 2.3 radii of the helix; the arcuate region is between 3.5 and 6.6 radii of the helix in length; the elongate deformable member is a wire; the elongate deformable member is a steel wire; the elongate deformable member is a nine gauge steel wire; the elongate deformable member is a galvanized steel wire; and the elongate deformable member is an aluminized steel wire.

A method of affixing fence fabric to a post having features of the present invention includes the steps of enclosing both a portion of a fence fabric and a fence post within the fence post tie described above and twisting the ends of that fence post tie.

A device having features of the present invention includes a fence post tie comprising an elongate deformable member that includes a substantially straight first end; a substantially straight second end that is opposite the first end with respect to the length of the member; and a central segment that is capable of substantially surrounding a majority of a perimeter of a post; wherein when equal and opposite forces are applied to the first end and the second end along a line that includes the first end and the second end in directions that would cause the first end and the second end to separate, a substantial portion of the total motion of the first end and the second end is in a direction that is perpendicular to a plane into which the member most closely fits, as determined by a least squares method of minimizing departures from the plane. In an embodiment of the invention, a portion of the central segment is linear and wherein upon tensioning the member sufficiently to create a durable connection between the first and second end enclosing a post, the linear central segment conforms to the shape of the post.

A device having features of the present invention includes a fence post tie comprising an elongate deformable member that includes a substantially straight first end; a substantially straight second end that is opposite the first end with respect to the length of the member; a means for conforming to a post having a first central axis; and a means for restricting; wherein upon sliding the means for restricting on to the post, such that the post enters the means for conforming to a post, the portion of the wire that makes up the means for conforming to the post departs substantially from a plane perpendicular to the post's central axis. In an embodiment of the invention, a portion of the means for conforming to a post is linear and wherein upon tensioning the member sufficiently to create a durable connection between the first and second end enclosing a post, the linear portion conforms to the shape of the post.

The above described advantages, other advantages and features of this invention will be apparent from the following description, appended claims and accompanying drawings.

DETAILED DESCRIPTION

As used herein the term "arcuate" shall mean having an appearance that is characteristic of any of the following: arcs, circles, helixes, or bows or essentially following a path that is characteristic of any of the following: arcs, circles, helixes, or bows.

Figure 1:
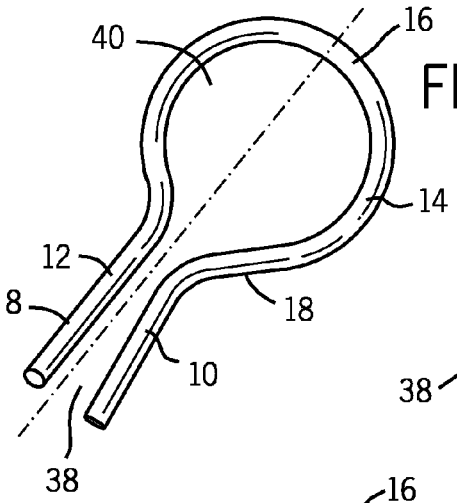
FIG. 1 shows a top elevation view of an embodiment of the invention.
Figure 2:
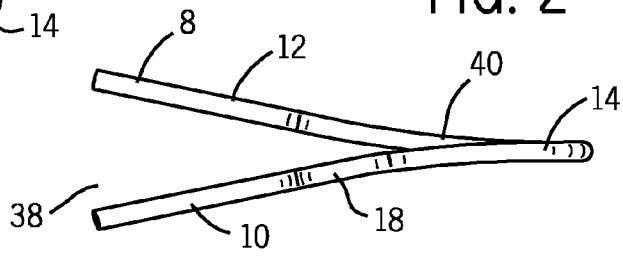
FIG. 2 is a side elevation view of an embodiment of the invention.
Figure 3:
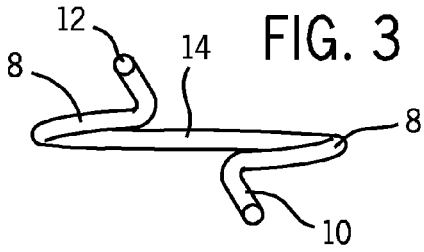
FIG. 3 is a front elevation view of an embodiment of the invention with the ends proximate to the viewer.
Figure 4:
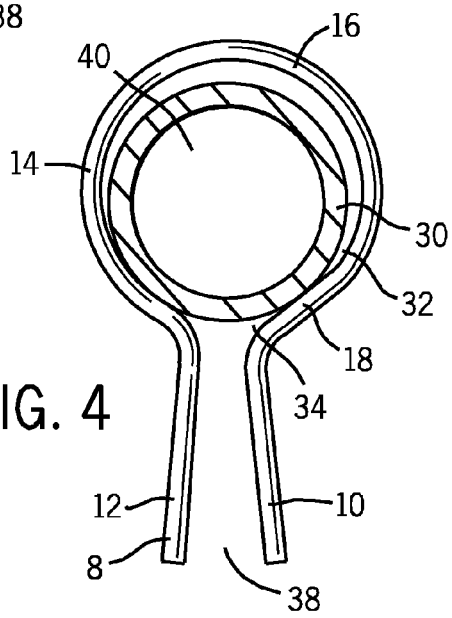
FIG. 4 shows a top elevation view of an embodiment of the invention engaged and surrounding the outer surface of a fence post.
Figure 5:
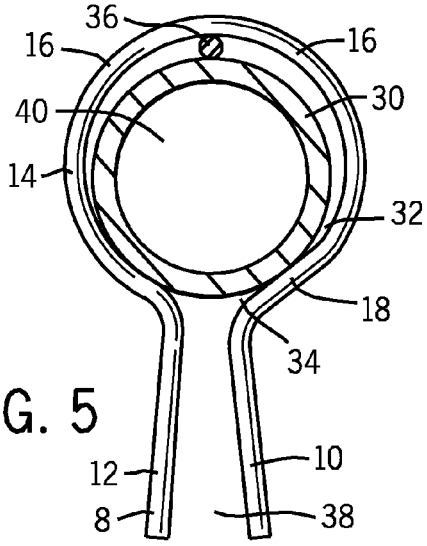
FIG. 5 is a top elevation view of an embodiment of the invention engaged and surrounding the outer surface of both a fence post and a single wire of fence fabric prior to the twisting of the ends.

Referring now to the drawings and more specifically to FIGS. 1, 2, 3, and 4; an embodiment of the invention includes a wire 8 bent into a three dimensional configuration. Wire 8 has a first end 10 and a second end 12 both of which are essentially straight. First end 10 and second end 12 are connected to each other by central segment 14 and separated by opening 38. Central segment 14 is configured so as to generally follow the external diameter of a post 30 as shown in FIG. 4 and as such is capable of substantially conforming to the outer diameter of a post 30 without deforming the member. FIGS. 1, 4 and 5 show central segment 14 containing an arcuate region 16 and a substantially linear region 18. In an embodiment of the invention, the arcuate region 16 takes the form of a helix configuration. When wire 8 is placed around a post 30 substantially linear region 18 is configured to remain in proximity to post 30. The result of placing wire 8 around post 30 is that first gap 32 and second gap 34 form between wire 8 and post 30. Thus, first end 10 is connected to substantially linear region 18 which is connected to arcuate region 16 which is connected to second end 12. The internal diameter of arcuate region 16 should be slightly larger than the outer diameter of post 30.

The following descriptions contain dimensional information for an embodiment of the invention and are illustrative only. Various modifications to the embodiment described will be apparent to one having ordinary skill in the fencing art based on the disclosures herein. Wire 8 was constructed from a nine gauge steel wire of 8.89 inches in length. The first end 10 is approximately 1.23 inches long and the second end 12 is approximately 1.4 inches long. Arcuate region 16 may be approximated by a segment of a helix having a diameter of 1.81 inches and a pitch of 0.81 inches. The length of arcuate region 16 is approximately 4.39 inches. The length of substantially linear region 18 is approximately 0.85 inches. Opening 38 is approximately 0.47 inches wide at the most narrow portion of the opening and 0.81 inches wide at the widest portion of the opening.

In an embodiment of the invention, fence posts having a 1⅝ inch diameter, wire gauges between eight and ten will be used. In a related embodiment, 9 gauge wire is used for fence posts having a 1⅝ inch diameter. In an embodiment of the invention, wire construction is selected from the following: steel, galvanized steel, aluminized steel, bright wire, and coated wire such as PVC coated steel and vinyl coated steel. In three embodiments that work with fences posts having a 1⅝ inch diameter, the length of wire 8 is between seven and eleven inches; the length of wire 8 is between eight and ten inches; and the length of wire 8 is approximately 8.9 inches. In one embodiment, first end 10 is between 0.9 inches and 1.75 inches, and in a related embodiment, first end 10 is approximately 1.23 inches. In one embodiment, second end 12 is between 1.0 and 2.0 inches and in a related embodiment, second end 12 is approximately 1.4 inches. In an embodiment of the invention, the helix referred to above has a diameter of between 1.75 and 2.25 inches and in a related embodiment, that diameter is approximately 1.81 inches. In three related embodiments of the invention, the helix referred to above has a pitch of between 0.25 inches and 1.75 inches; a pitch of between 0.5 and 1.5 inches; and a pitch of between 0.75 inches and 1.25 inches. In an embodiment of the invention, the length of arcuate region 16 is between 4.0 and 5.0 inches and in a related embodiment, the length of arcuate region 16 is between 4.25 and 4.75 inches. In an embodiment of the invention, the length of substantially linear region 18 is between 0.5 and 2.0 inches and in a related embodiment, the length of substantially linear region 18 is between 0.75 and 1.5 inches. In an embodiment of the invention opening 38 is between 0.25 and 0.75 inches at its most narrow point and between 0.5 inches and 1.75 inches at its widest point.

One having ordinary skill in the art would recognize that various other embodiments could be constructed consistent with disclosures herein. For sizes of fence post other than 1⅝ inches in diameter the lengths can be expressed as a multiple of the radius of the arcuate region 16 with the following descriptions characterizing lengths as a function of the radius of the arcuate region 16. In an embodiment of the invention, first end 10 is between 0.8 radii and 2.3 radii and in a related embodiment, first end 10 is approximately 1.4 radii. In an embodiment of the invention, second end 12 is between 0.9 and 2.6 radii and in a related embodiment, second end 12 is approximately 1.5 radii. In three related embodiments of the invention, the helix referred to above has a pitch of between 0.2 radii and 2.3 radii; between 0.5 and 2.0 radii; and between 0.6 radii and 1.7 radii. In an embodiment of the invention, the length of arcuate region 16 is between 3.5 and 6.6 radii and in a related embodiment, arcuate region 16 is between 3.8 and 6.2 radii. In an embodiment of the invention, the length of substantially linear region 18 is between 0.5 and 2.6 radii and in a related embodiment, linear region 18 is between 0.6 and 2.0 radii. In an embodiment of the invention, opening 38 is between 0.2 and 1.0 radii at its most narrow point and between 0.5 radii and 2.3 radii at its widest point. In an embodiment of the invention, when central segment 14 is arranged to surround post 30 in the manner shown in FIG. 4, the maximum gap between central segment 14 and post 30 is between 0.08 and 0.4 radii. In a related embodiment, that maximum gap is between 0.12 and 0.3 radii and in a further related embodiment, that maximum gap is approximately 0.2 radii. In an embodiment of the invention, post 30 has an outer surface radius of approximately 0.9 of the inner surface radius of the helix of arcuate region 16.

Various modifications to the embodiments above can be made without departing from the spirit of the invention. Various gauges of wire may be used in the inventions. In related embodiments of the invention, gauges of wire between 4 and 13 are used. In an embodiment of the invention, gauges of wire between 6 and 12 are used for posts having a diameter of 1⅝ inches. In an embodiment of the invention, the fence tie is used on posts having diameters between 1 and 12 inches. Substantially linear region 18 can be placed in any location within central segment 14. In an embodiment of the invention, substantially linear region 18 is placed near either first end 10 or second end 12 such that it is easily viewed by a person twisting first end 10 and second end 12 together.

The invention may be constructed on a computer numerically controlled wire bender such as the 3D8T machines available from Automated Industrial Machinery, Inc. or other mechanical wire benders.

Figure 6:
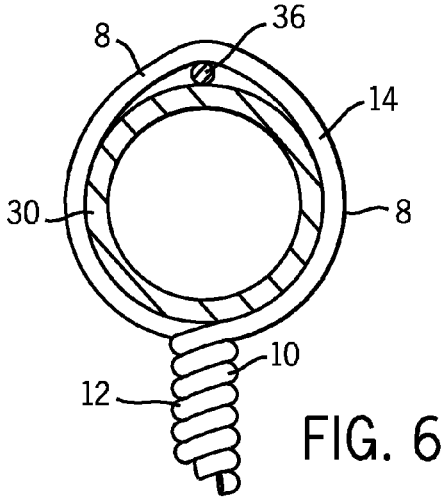
FIG. 6 is a top elevation view of an embodiment of the invention engaged and surrounding the outer surface of both a fence post and a single wire of fence fabric after the ends have been twisted to secure the fabric.

The uses of various embodiments of the invention will be apparent from the following description of how the above-described embodiment of the invention may be employed to secure fence fabric to a fence post as illustrated by FIGS. 4, 5 and 6. Fence fabric is placed against post 30 in a way that places fence fabric wire 36 against the post 30 as shown in FIG. 5. With wire 8 initially oriented such that first end 10 and second end 12 are nearest fence fabric wire 36, wire 8 is slid over fence fabric wire 36 and post 30 so that both fence fabric wire 36 and post 30 pass through opening 38 and into space 40 creating the configuration seen in FIG. 5. In an embodiment of the invention, the portions of the wire that are adjacent to the narrowest portion of opening 38 may be considered a means for restricting the entry of a post into space 40. Other configurations of wire creating a similarly narrow opening could also be considered a means for restricting such entry. The three dimensional helical configuration of arcuate region 16 allows the first end 10 to separate more easily from second end 12 than is typical of similar devices in which the wire is bent in only two dimensions. This ease of bending allows post 30 to pass through opening 38 and into space 40 with greater ease, thereby reducing the total effort necessary to secure the fence fabric to a fence post. In an embodiment of the invention, arcuate region 16 is a means for conforming to a post. Additional means for conforming to a post include configurations in the form of circles, helixes, or bows. First end 10 and second end 12 are then twisted together using any suitable means such as a drill, pliers or other tool. Further examples of such suitable means for accomplishing the twisting are disclosed in U.S. Pat. Nos. 385,318 entitled IMPLEMENT FOR BENDING WIRE and 5,275,383 entitled METHOD AND WIRE TIE CONNECTION FOR SECURING FENCING FABRIC TO POSTS; and United States Patent Application Publication 2004/0016917 entitled DEVICE AND METHOD FOR TWIST FASTENING WIRE. During the twisting process, first gap 32 and second gap 34 are monitored. When the twisting is sufficient to cause either or both of first gap 32 and second gap 34 to disappear, then the wire has been properly tensioned and the twisting is complete. Upon completion of the twisting, wire 8 will substantially conform to post 30 and fence fabric wire 36 in the manner shown in FIG. 6. Ceasing the application of the twisting force upon the disappearance of first gap 32 can prevent both over tensioning of wire 8 and under tensioning of wire 8.

Any and all reference to patents, documents and other writings contained herein shall not be construed as an admission as to their status with respect to being or not being prior art. It is understood that the array of features and embodiments taught herein may be combined and rearranged in a large number of additional combinations not directly disclosed, as will be apparent to one having skill in the art.

There are of course other alternate embodiments which are obvious from the foregoing descriptions of the invention, which are intended to be included within the scope of the invention, as defined by the following claims.

I claim:

1. A fence post tie comprising:

a. A wire comprising
   i. a substantially straight first end, said substantially straight first end having a free end,
   ii. a substantially straight second end, said substantially straight second end having a free end,
   iii. an arcuate region, and
   iv. a substantially straight intermediate region;

b. wherein the arcuate region is connected to the substantially straight intermediate region;

c. wherein the substantially straight first end is adjacent to the arcuate region;

d. wherein the substantially straight first end is connected to the arcuate region by a first bend in the wire;

e. wherein the substantially straight second end is adjacent to the substantially straight intermediate region;

f. wherein the substantially straight second end is connected to the substantially straight intermediate region by a second bend in the wire;

g. wherein the arcuate region is in the form of a helix;

h. wherein the helix has a pitch of between 0.2 radii and 2.3 radii of the helix;

i. wherein the first bend and the second bend are separated by a bend separation distance greater than 0.2 radii of the helix.

2. The fence post tie of claim 1 wherein the arcuate region has a length between 3.5 and 6.6 radii of the helix.

3. The fence post tie of claim 1 wherein the substantially straight intermediate region is between 0.5 and 2.6 radii of the helix long.

4. The fence post tie of claim 1 a. wherein the substantially straight first end has a first tip;

b. wherein the substantially straight second end has a second tip; and c. wherein the first tip and the second tip are separated by a tip separation distance between 0.2 and 2.3 radii of the helix.

5. The fence post tie of claim 1 wherein the wire has a diameter between 6 gauge and 12 gauge.

6. A method of affixing fence fabric comprising: enclosing both a portion of a fence fabric and a post within the fence post tie of claim 1 and twisting the substantially straight first end together with the substantially straight second end.

7. A fence post tie comprising:

a. A wire comprising
   i. a substantially straight first end, said substantially straight first end having a free end,
   ii. a substantially straight second end, said substantially straight second end having a free end,
   iii. an arcuate region, and
   iv. a substantially straight intermediate region;

b. wherein the arcuate region is connected to the substantially straight intermediate region;

c. wherein the substantially straight first end is adjacent to the arcuate region;

d. wherein the substantially straight first end is connected to the arcuate region by a first bend in the wire;

e. wherein the substantially straight second end is adjacent to the substantially straight intermediate region;

f. wherein the substantially straight second end is connected to the substantially straight intermediate region by a second bend in the wire;

g. wherein the arcuate region is substantially in the form of a helix;

h. wherein the wire has a diameter between 6 gauge and 12 gauge;

i. wherein the arcuate region and the substantially straight intermediate region are arranged and configured to closely fit around a cylindrical post and j. wherein the substantially straight first end and the substantially straight second end are separated by a distance sufficient to pass the cylindrical post between the substantially straight first end and the substantially straight second end.

* * * * *